US006435275B1

(12) United States Patent
Kirk et al.

(10) Patent No.: US 6,435,275 B1
(45) Date of Patent: Aug. 20, 2002

(54) CASING CENTRALISER

(75) Inventors: Ian Alastair Kirk; William Barron; Alistair Bertram Clark, all of Aberdeen (GB)

(73) Assignee: Downhole Products plc, Portlethen (GB)

( * ) Notice: Subject to any disclaimer, the term of this patent is extended or adjusted under 35 U.S.C. 154(b) by 0 days.

(21) Appl. No.: 09/378,858

(22) Filed: Aug. 23, 1999

(51) Int. Cl.[7] ..... E21B 17/10

(52) U.S. Cl. ..... 166/241.1; 166/241.3

(58) Field of Search ..... 166/241.1, 241.3, 166/241.4, 241.6; 175/325.1, 325.5

(56) References Cited

U.S. PATENT DOCUMENTS

| | | | | | |
|---|---|---|---|---|---|
| 2,166,116 | A | * | 7/1939 | Bettis | 166/241.6 |
| 3,320,004 | A | | 5/1967 | Garrett | |
| 3,528,499 | A | | 9/1970 | Collett | 166/175 |
| 3,613,783 | A | * | 10/1971 | Seabourn | 166/241.6 X |
| 3,933,203 | A | * | 1/1976 | Evans | 166/241.6 |
| 3,963,075 | A | * | 6/1976 | Evans | 166/241.6 |
| 4,050,514 | A | | 9/1977 | Prenn | 166/176 |
| 4,088,185 | A | | 5/1978 | Carson | 166/176 |
| 4,757,861 | A | | 7/1988 | Klyne | 166/241 |
| 4,796,670 | A | | 1/1989 | Russell et al. | |
| 4,858,688 | A | | 8/1989 | Edwards et al. | 166/241 |
| 4,919,202 | A | | 4/1990 | Clintberg | 166/176 |
| 4,938,299 | A | | 7/1990 | Jelsma | |
| 4,984,633 | A | | 1/1991 | Langer et al. | |
| 5,095,981 | A | | 3/1992 | Mikolajczyk | 166/241.6 |
| 5,115,863 | A | | 5/1992 | Olinger | 166/241 |
| 5,179,140 | A | | 1/1993 | Ariannejad | 523/440 |
| 5,191,938 | A | | 3/1993 | Sable et al. | 166/378 |
| 5,212,885 | A | | 5/1993 | Buonodono et al. | 29/890.14 |
| 5,247,990 | A | | 9/1993 | Sudol et al. | |
| 5,277,254 | A | | 1/1994 | Rullman et al. | 166/241.4 |
| 5,318,805 | A | | 6/1994 | Wu | 427/386 |
| 5,339,896 | A | | 8/1994 | Hart et al. | 166/241.1 |
| 5,492,174 | A | * | 2/1996 | O'Hair | 166/241.4 |
| 5,575,333 | A | | 11/1996 | Lirette et al. | 166/241.1 |
| 5,692,562 | A | | 12/1997 | Squires | 166/68.5 |
| 5,908,072 | A | * | 6/1999 | Hawkins | 166/241.6 |
| 5,937,948 | A | * | 8/1999 | Robbins, III | 166/380 |
| 6,006,830 | A | * | 12/1999 | Barron et al. | 166/241.6 |

FOREIGN PATENT DOCUMENTS

| | | |
|---|---|---|
| EP | 0 138 603 A2 | 4/1985 |
| EP | 0 297 716 A1 | 1/1989 |
| EP | 0 671 546 A1 | 9/1995 |
| GB | 682362 | 5/1952 |
| GB | 2 016 063 A | 9/1979 |
| GB | 2 171 436 A | 8/1986 |
| GB | 2 226 520 A | 7/1990 |
| GB | 2 282 615 A | 4/1992 |
| GB | 2 249 333 A | 5/1992 |
| GB | 2 275 284 A | 8/1994 |
| GB | 2 285 649 A | 7/1995 |
| GB | 2 288 198 A | 10/1995 |
| GB | 2 304 753 A | 3/1997 |
| WO | 91/05936 | 5/1991 |
| WO | 95/21986 | 8/1995 |
| WO | 96/34173 | 10/1996 |
| WO | 98/37302 | 8/1998 |
| WO | 99/25949 | 5/1999 |

* cited by examiner

*Primary Examiner*—Frank S. Tsay
(74) *Attorney, Agent, or Firm*—RatnerPrestia

(57) ABSTRACT

A casing centraliser and assembly comprising a tubular and a centraliser, the centraliser comprising a plastics material.

18 Claims, 5 Drawing Sheets

CASING CENTRALISER

The invention relates to a casing centralizer. This application is a Continuation-In-Part of PCT/GB98/00554 to which filing details have not yet been assigned by the USPTC.

BACKGROUND TO THE INVENTION

When a well has been drilled for the eventual production of hydrocarbons, one of the procedures commonly employed in readying the well for production comprises installing hollow tubular casing in the well to line the borehole. The space between the exterior of the casing and the sides of the borehole are filled with cement, which acts as a sealant and provides mechanical support for the casing. As it is desirable that the casing be centralized in the well bore when cemented, proposals have been made for providing the casing (prior to cementing) with externally mounted centralisers to hold the casing away from the well bore and towards the centre of the bore.

SUMMARY OF THE INVENTION longitudinally therethrough, the annular body being formed from at least one material selected from the group consisting of plastic material, elastomeric material and rubber material, the substantially cylindrical bore being a clearance fit around the tubular casing to be centralised by the centralizer.

In a preferred embodiment the invention provides a casing centralizer assembly comprising tubular casing and a centraliser as defined above.

Typically, the plastic, elastomeric and/or rubber material may comprise polytetrafluoroethylene (PTFE), polyetheretherketone, carbon reinforced polyetheretherketone, polyphthalamide, polyvinylidene fluoride, polyphenylylene sulphide, polyetherimide, polyethylene, polysulphone, polyethersulphone, polybutyleneteraphthalate, polyetherketoneketone, polyamides, a rubber & rubber compounds, phenolic resins or compounds, thermosetting plastics, thermoplastic elastomers, thermoplastic compounds or thermoplastic polyester resins.

In one example of the invention, the plastic, elastomeric or rubber material may contain a filler material, such as glass, carbon, PTFE, silicon, molybdenum disulphide, graphite, oil or wax, or any combination of these materials.

The annular body may be manufactured from and consist of the plastic, elastomeric and/or rubber material. However, the annular body may comprise a combination of the plastic, elastomeric and/or rubber material and another material such as a metal. For example, the annular body may comprise a metal skeleton or other structure coated, or partially coated, with the plastic, elastomeric or rubber material. In addition, or as an alternative, the annular body may comprise a combination of different plastic, elastomeric and/or rubber materials.

The annular body may be formed in one or more sections which may be assembled around the tubular to be centralised by the centralizer. In one embodiment the annular body is divided into 2 sections along its axis so that each section forms a "half shell" arrangement. The concave surface of one section can be fitted direct against one side of the outer surface of the tubular and connected to another section similarly positioned against the opposite side of the tubular. The 2 sections can then be connected around the tubular to make up the centralizer so that it does not need to be offered up to the end of the tubular. This can be very useful in coil tubing applications.

The division between the sections need not be axial.

In some embodiments the sections can be hingedly attached to one another. In others the 2 sections can be separate. There can be more than 2 sections provided. It is sufficient that the sections are adapted to allow the centraliser to be placed around the tubular without needing to be threaded over an end of the tubular.

The sections are preferably held together by fixings and/or hinges. Preferred fixings include bolts but catches and locks can also be used.

Preferably the centraliser further comprises a peripheral array of a plurality of longitudinally extending blades circumferentially distributed around said body to define a flow path between each circumferentially adjacent pair of said blades, each said flow path providing a fluid flow path between longitudinally opposite ends of said centralizer, each said blade having a radially outer edge providing a well bore-contacting surface.

Said centralizer is preferably free of any means tightly gripping a casing when said centralizer is installed thereon, whereby said centralizer and said casing are mutually rotatable.

Said blades are preferably mutually substantially equidistantly distributed around said body. Said blades preferably each extend circumferentially at least part-way around said body between longitudinally opposite ends thereof to provide a circumferential distribution of each said well bore-contacting surface. Each said blade preferably has a radially inner root integral with said body, each said radially inner root preferably being circumferentially wider than the respective radially outer edge. Said blades are preferably circumferentially wider at one end of the centralizer than at the other end, said one end preferably the lower end of the centralizer in use thereof. Said centralizer preferably has five of said blades.

Longitudinally opposite ends of said blades and/or of said body may be chamfered or tapered whereby to facilitate passage of said centralizer down a well bore.

BRIEF DESCRIPTION OF THE DRAWINGS

Examples of a casing centralizer in accordance with the invention will now be described with reference to the accompanying drawings, in which.

DESCRIPTION OF PREFERRED EMBODIMENTS

Figure 1:
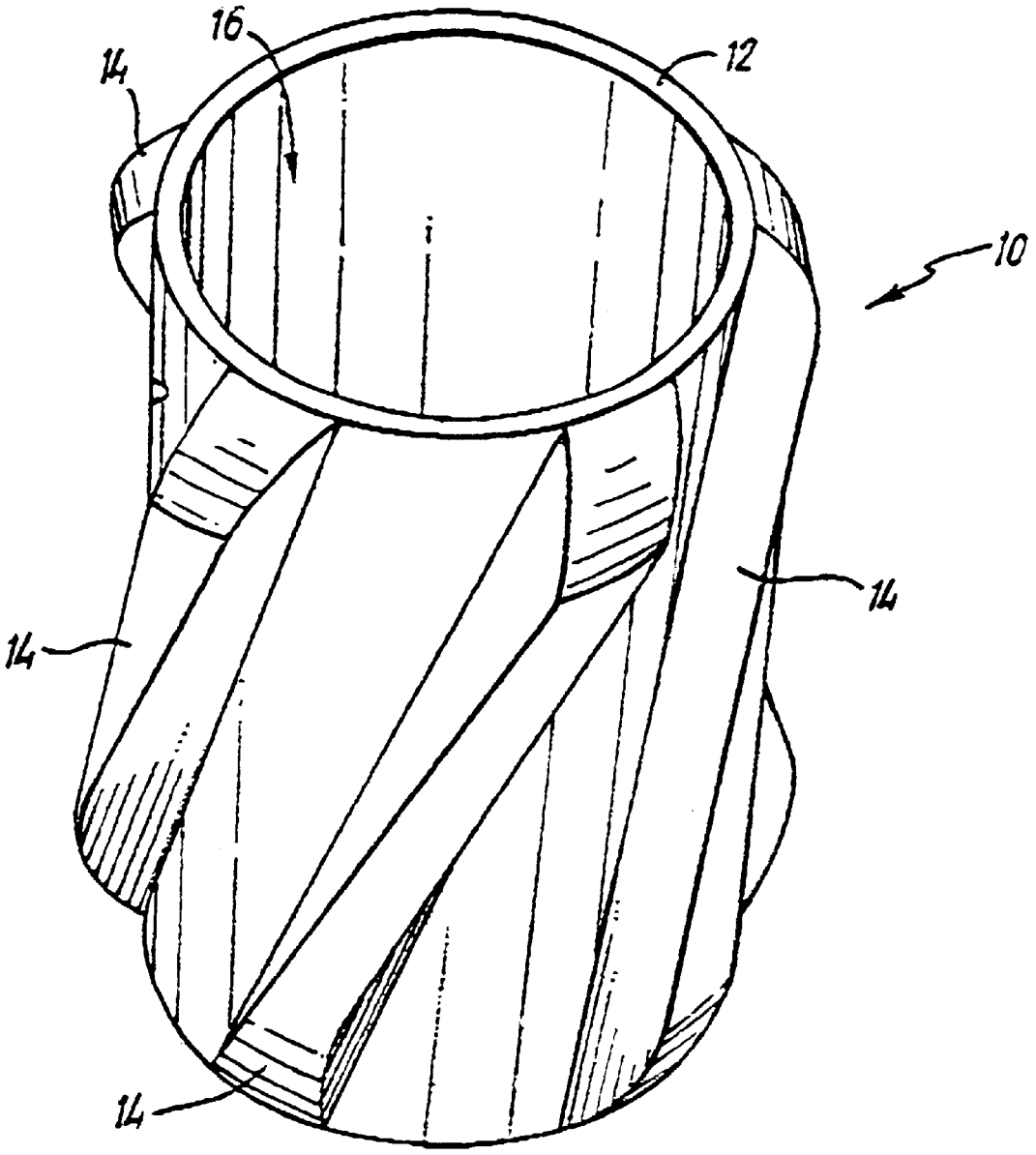
FIG. 1 is a perspective view from above and to one side of a first example of a casing centralizer.
Figure 2:
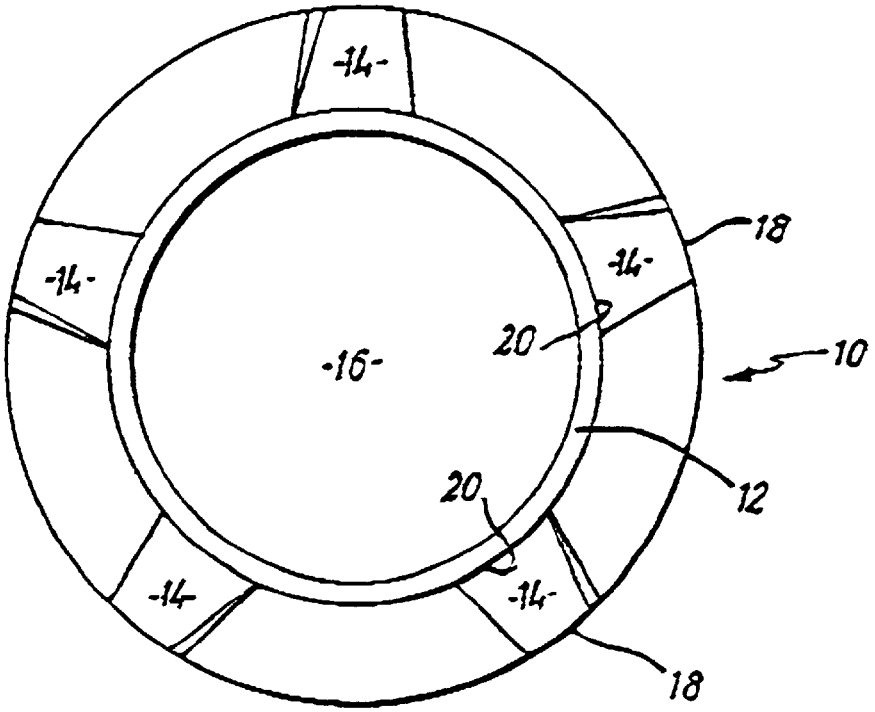
FIG. 2 is a plan view from above of the first example.
Figure 3:
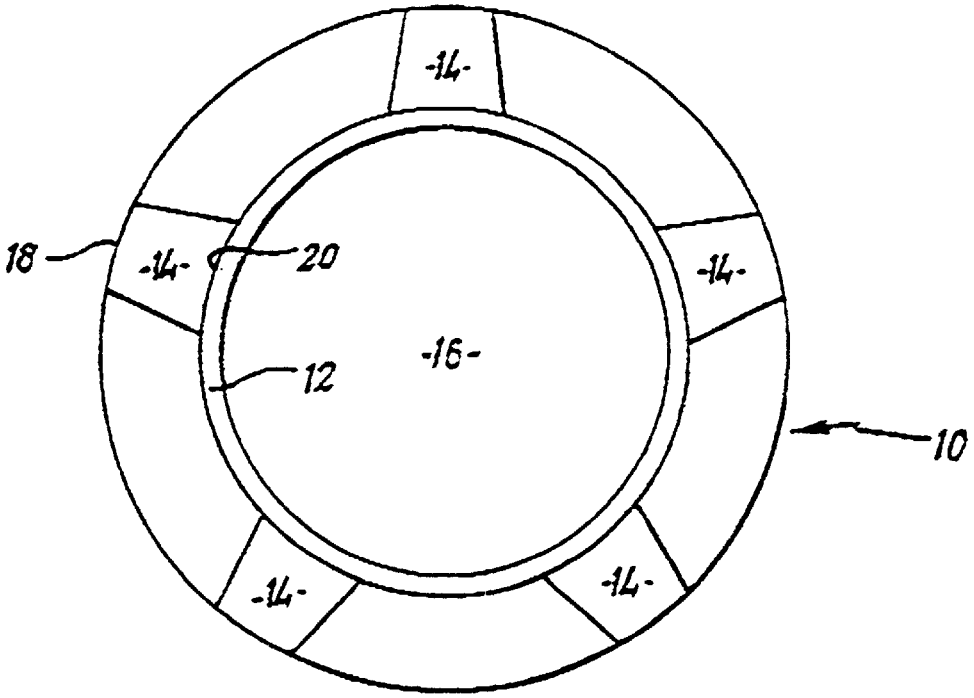
FIG. 3 is an underneath view of the first example.

Referring first to FIGS. 1 to 3, a casing centralizer 10 is a unitary annulus comprising a generally cylinder body 12, and an array of five equiangularly-spaced blades 14 integrally formed with the body 12. A cylindrical bore 16 extends longitudinally and coaxially through the body 12, the bore 16 having a substantially uniform diameter dimensioned to be a clearance fit around the well bore casing (not shown in FIGS. 1 to 8). Each of the blades 14 (see also FIGS. 4 and 5) not only extends between longitudinally opposite ends of the body 12, but also extends circumferentially part-way around the periphery of the centralizer. The skewing of the blade 14 ensures that their respective radially outer edges 18 collectively provide a circumferentially substantially uniform well bore-contacting surface for the centralizer 10, as most particularly shown in FIGS. 2 and 3.

Each of the blades 14 has a respective radially inner root 20 integral with the body 12. In each of the blades 14, the root 20 has a greater circumferential width than the outer edge 13, ie the cross-section of each blade 14 tapers towards the well bore-contacting periphery of the centralizer 10. The individual and collective shapes of the blades 14, and of the longitudinal fluid flow passages defined between adjacent pairs of the blades 14, gives the centralizer 10 improved flow characteristics and minimises the build-up of trapped solids during use of thecentralizer 10.

Longitudinally opposite ends of the blades 14, and of the body 12, are chamfered to assist in movement of the centralizer 10 up/down a well bore.

Figure 4:
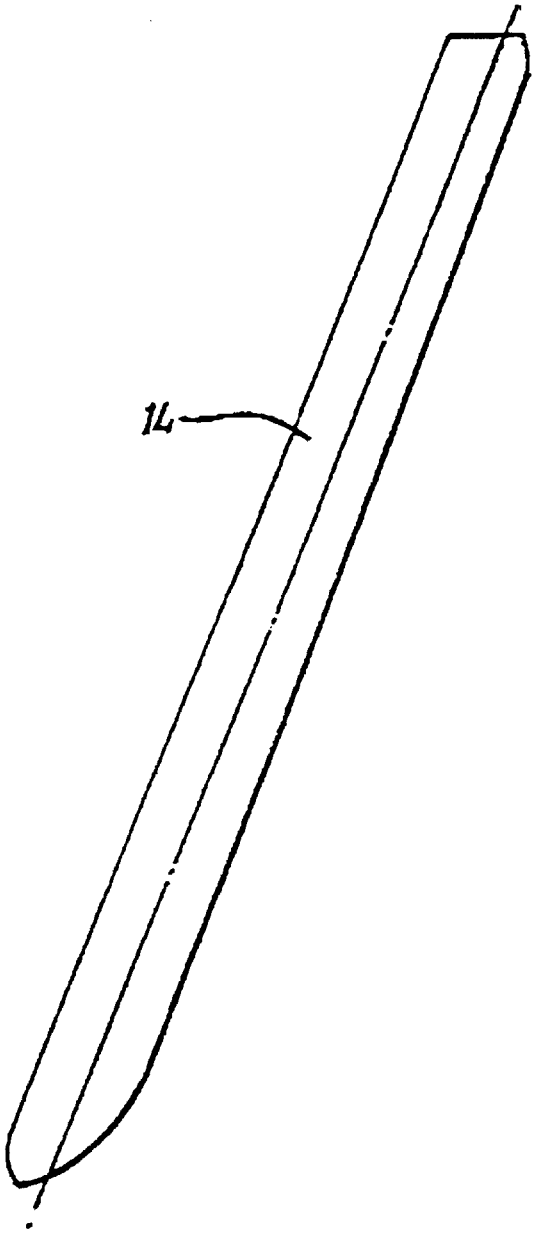
FIGS. 4 and 5 are respectively radial (plan) and circumferential (side) views of a blade forming part of the first example.
Figure 5:
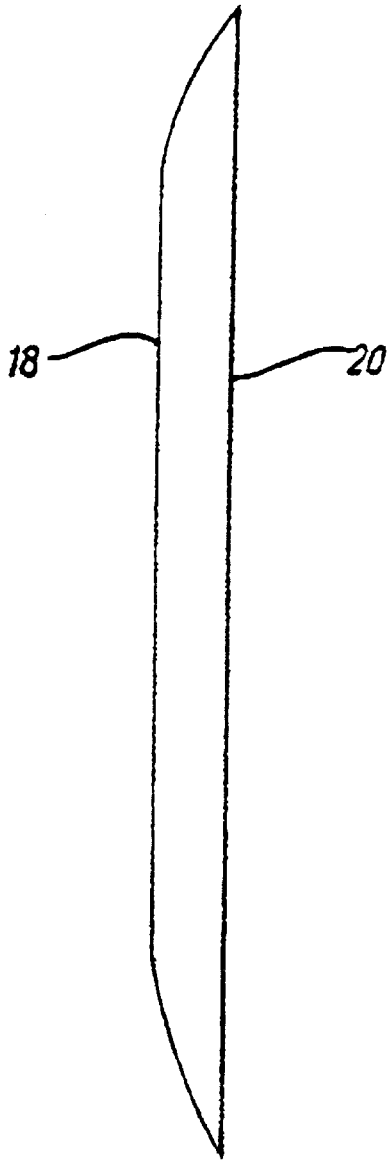

Although the blades 14 are shown separately from the body 12 in FIGS. 4 and 5 (and while the blades 4 could be separately formed and subsequently attached to the body 12 by any suitable means) it is preferred that the entire centralizer 10 is fabricated as a one-piece article.

The centralizer 10 may be manufactured entirely from a plastics, elastomeric and/or rubber material. Alternatively, the centralizer may comprise a metal body coated, or partially coated, with a plastic elastomeric and/or rubber material.

Examples of possible plastic, elastomeric and/or rubber materials are polytetrafluoroethylene (PTFE), polyetheretherketone, carbon reinforced polyetheretherketone, polyphthalamide, polyvinylidene fluoride, polyphenylylene sulphide, polyetherimide, polyethylene, polysulphone, polyethersulphone, polybutyleneterephthalate, polyetherketoneketone, polyamides, rubber & rubber compounds, phenolic resins or compounds, thermosetting plastics, thermoplastic elastomers, thermoplastic compounds or thermoplastic polyester resins.

The plastics elastomeric and/or rubber material may contain a filler. Examples of possible fillers are glass, carbon, PTFE, silicon, molybdenum disulphide, graphite, oil or wax, or any combination of these materials.

Use of a plastic, elastomeric and/or rubber material gives a number of advantages, including:—chemical resistance, such as resistance to acid; non-sparking (ie sparks are not generated if the centraliser in 10 collides with steel); and, materials such as PTFE give superior bearing properties.

Since the bore 16 is clearance fit around the casing and since the bore 16 lacks any means of tightly gripping a normally dimensioned casing, the centraliser 10 can not only rotate freely around the casing but also move freely along the casing (unless and until the centraliser collides with an obstruction, for example a protruding casing joint). Thus to provide longitudinal restraint for the centralizer 10 to retain the centraliser substantially at its preferred location along the casing but without impairing the relative rotatability of centralizer and casing, use is made of a stop collar 50, as illustrated in FIG. 6.

Figure 6:
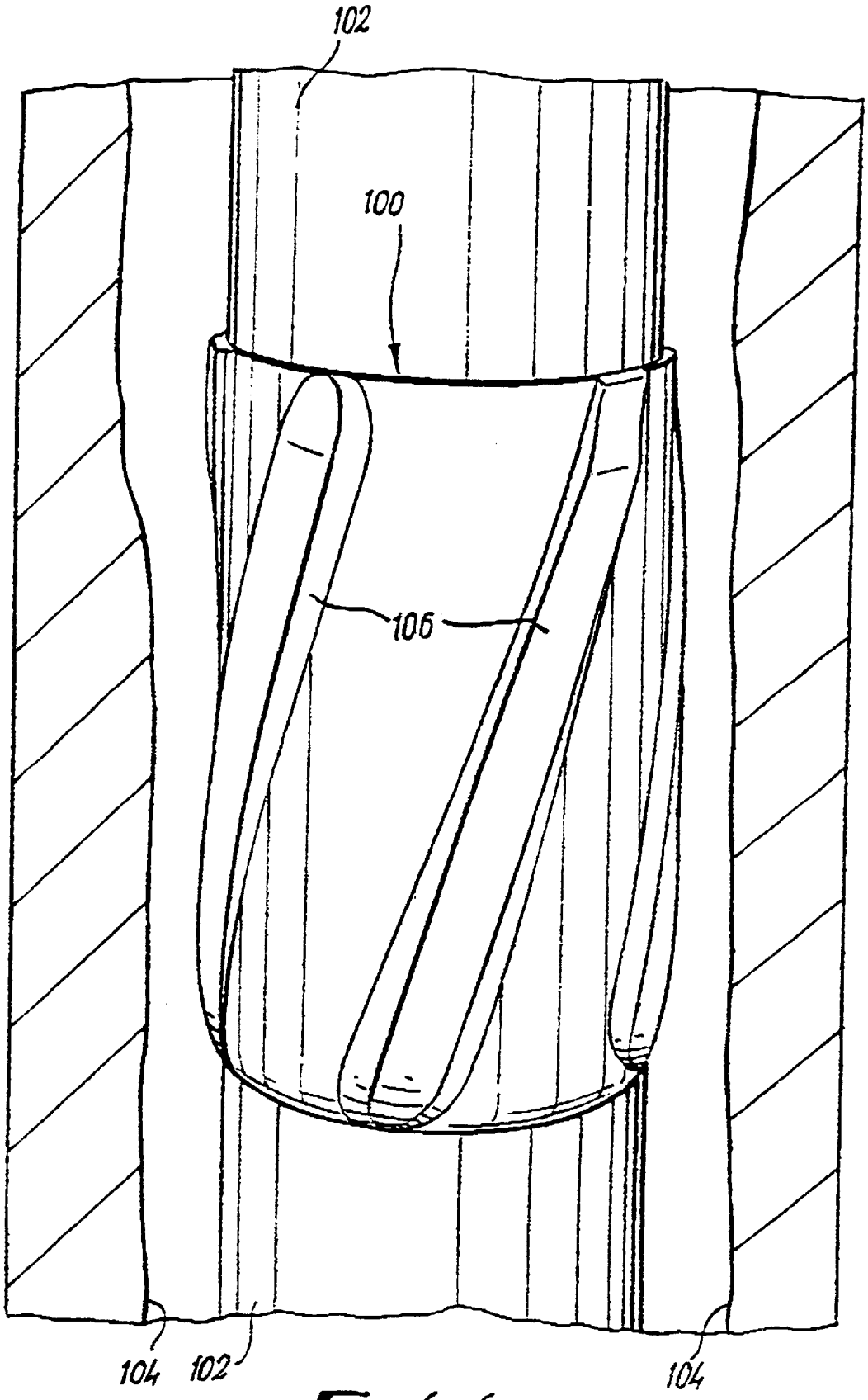
FIG. 6 is a perspective view of a casing centralizer mounted on casing in a borehole.

FIG. 6 shows a modified form of casing centralizer 100, fitted around hollow tubular casing 102 which is located within a well bore 104. The modified centralizer 100 is essentially the same as the centralizer 10 described above, and differs principally in the dimensions and proportions of its blades 106. In particular, the blades 106 are circumferentially wider at the lower end of the centralizer 100 than they are at the upper end. FIG. 6 also illustrates the manner in which the centralizer will hold casing out of direct contact with the well bore and centrally within the well bore, in preparation for subsequent cementing.

Figure 7A:
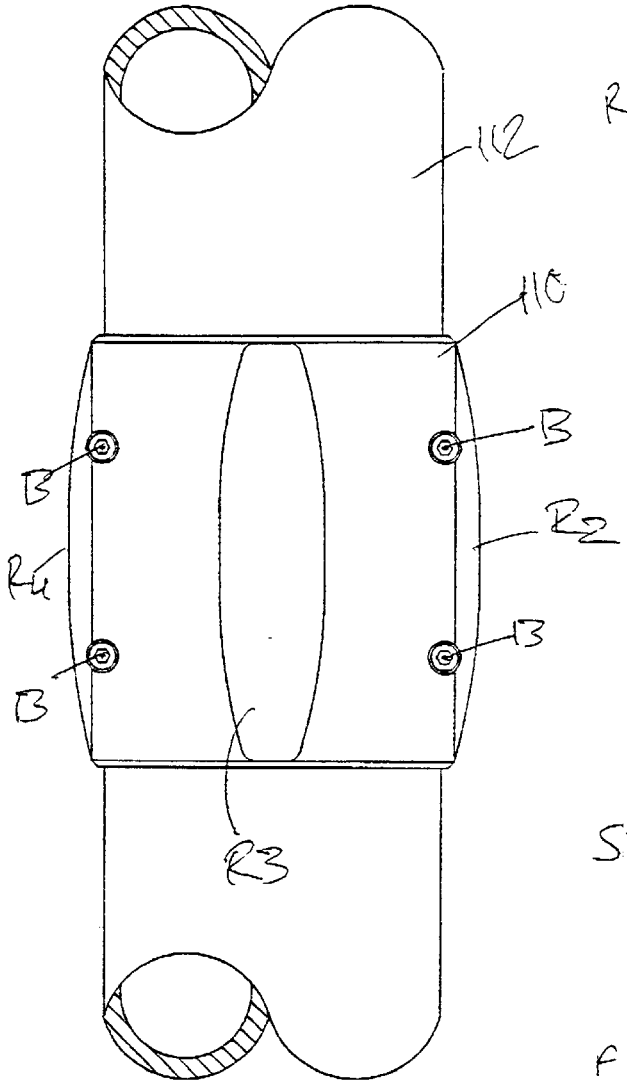
FIG. 7*a* shows a side view of a second centralizer on a tubular.
Figure 7B:
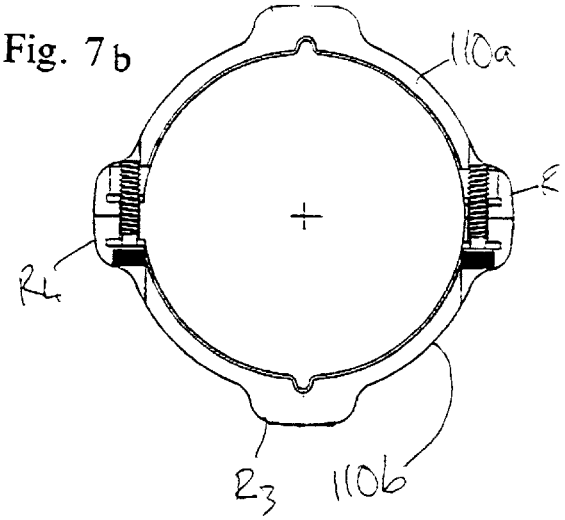
FIG. 7*b* shows the same centralizer in plan view.
Figure 7C:
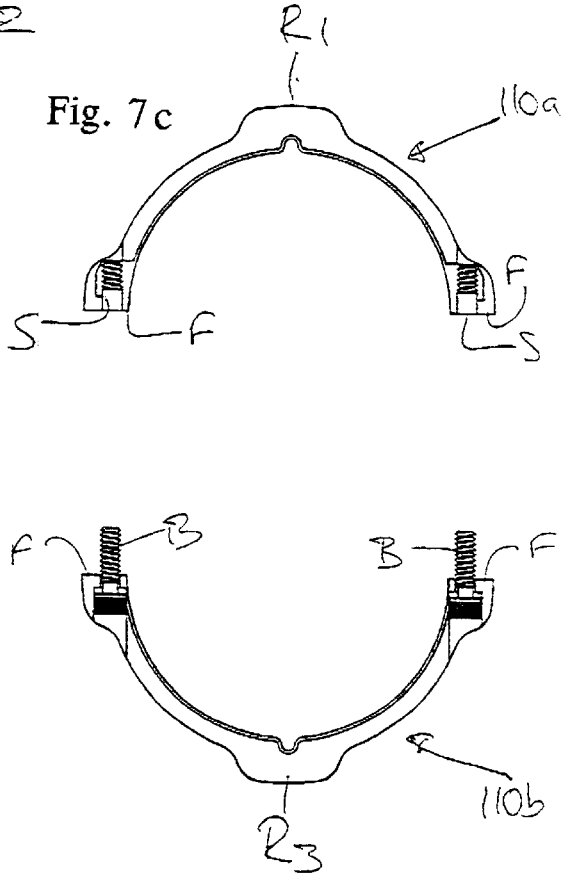
FIG. 7*c* shows the same centralizer in exploded plan view.

FIG. 7 shows a modified plastic centralizer 110 located around a length of casing 112. The centralizer 110 has blades R1, R2, R3 and R4 spaced around its outer surface to contact the inner surface of the wellbore and to centralize the casing 112 therein. The blades R extend axially along the centralizer but can alternatively extend around the outer circumference of the centralizer like the blades 106.

The centralizer 110 is axially divided along the midline of opposing blades R2 and R4 to form two half shells 110*a* and 110*b*, so that the blades R2 and R4 are formed only when the opposing faces F of the half shells 110*a* and 110*b* are joined together. Half shell 110*a* has two threaded sockets S in each of the faces F of R2 and R4 to receive bolts B protruding through the faces F of the other half shell 110*b*. The bolts B engage in the sockets S and pull the faces F together when the centralizer 110 is made up around the casing 112 and the bolts tightened.

The centralizer 110 can be formed from polytetrafluoroethylene (PTFE), polyetheretherketone, carbon reinforced polyetheretherketone, polyphthalamide, polyvinylidene fluoride, polyphenylylene sulphide, polyetherimide, polyethylene, polysulphone, polyethersulphone, polybutyleneterephthalate, polyetherketoneketone, polyamides, rubber & rubber compounds, phenolic resins or compounds, thermosetting plastics, thermoplastic elastomers, thermoplastic compounds of thermoplastic polyester resins.

The centralizer 110 is useful with coil tubing applications, but may also be used for casing and screens to afford protection from acids and other harmful chemicals downhole.

In the case of casing located within larger diameter casing, centralizers can be employed on the inner casing to hold it out of direct contact with the outer casing.

Advantages of the invention are that the use of a plastic, elastomeric and/or rubber material for the centraliser helps to provide chemical resistance, such as resistance to corrosion from acid. Other advantages are that the materials are generally non sparking and that certain materials for example PTFE, have superior bearing properties.

What is claimed is:

1. A casing centraliser comprising an annular body, the annular body having a substantially cylindrical bore extending longitudinally therethrough, the annular body being formed from at least one material selected from the group consisting of plastic material, elastomeric material and rubber material, the substantially cylinderical bore being a clearance fit around the tubular casing to be centralised by the centraliser, wherein the centraliser is of unitary construction.

2. A casing centralizer as claimed in claim 1 wherein the material is selected from the group consisting of polytetrafluoroethylene (PTFE), polyetheretherketone, carbon reinforced polyetheretherketone, polyphthalamide, polyvinylidene fluoride, polyphenylylene sulphide, polyetherimide, polyethylene, polysulphone, polyethersulphone, polybutyleneterephthalate, polyetherketoneketone, polyamide, rubber & rubber compounds, phenolic resins or compounds, thermosetting plastics, thermoplastic elastomers, thermoplastic compounds and thermoplastic polyester resins.

3. A casing centralizer as claimed in claim 1 wherein the material contains a filler material.

4. A casing centralizer as claimed in claim 3 wherein the filler material is selected from the group consisting of glass, carbon, PTFE, silicon, molybdenum disulphide, graphite, oil and wax.

5. A casing centralizer as claimed in claim 1, wherein the annular body comprises a combination of at least two different materials.

6. A casing centralizer as claimed in claim 1, having a peripheral array of a plurality of longitudinally extending blades circumferentially distributed around the body of the centralizer to define a flow path between each circumferentially adjacent pair of said blades, each said flow path providing a fluid flow path between longitudinally opposite ends of said centralizer, each said blade having a radially outer edge providing a well bore-contacting surface.

7. A casing centralizer as claimed in claim 6, wherein the blades are mutually substantially equidistantly distributed around the body.

8. A casing centralizer as claimed in claim 6, wherein the blades each extend circumferentially at least part-way around said body between longitudinally opposite ends thereof to provide a circumferential distribution of each said well bore-contacting surface.

9. A casing centralizer as claimed in claim 6, wherein each blade has a radially inner root integral with said body, each said radially inner root preferably being circumferentially wider than the respective radially outer edge.

10. A casing centraliser as claimed in claim 6, wherein the blades are circumferentially wider at a lower end of the centralizer than at the upper end.

11. A casing centralizer as claimed in claim 6, wherein said centralizer has five of said blades.

12. A casing centralizer as claimed in claim 1, substantially free of any means tightly gripping a casing when said centralizer is installed thereon, whereby said centralizer and said casing are mutually rotatable.

13. A casing centralizer assembly comprising tubular casing and a centralizer as claimed in claim 1.

14. A casing centralizer comprising an annular body, the annular body having a substantially cylindrical bore extending longitudinally therethrough, the annular body being formed from at least one material selected from the group consisting of plastic material, elastomeric material and rubber material, the substantially cylindrical bore being a clearance fit around the tubular casing to be centralised by the centraliser, wherein the annular body is divided along its axis into at least two inter-connectable sections.

15. A casing centralizer as claimed in claim 14, wherein each of said at least two inter-connectable sections is adapted to allow the centralizer to be placed around the tubular without needing to be threaded over an end of the tubular.

16. A casing centralizer as claimed in claim 14, wherein the division between the sections is not axial.

17. A casing centralizer as claimed in claim 14, wherein the sections are hingedly attached to one another.

18. A casing centralizer as claimed in claim 14, wherein the sections are held together by fixings.

* * * * *

US006435275C1

(12) EX PARTE REEXAMINATION CERTIFICATE (10757th)

United States Patent
Kirk et al.

(10) Number: US 6,435,275 C1
(45) Certificate Issued: Nov. 6, 2015

(54) CASING CENTRALISER

(75) Inventors: Ian Alastair Kirk, Aberdeen (GB); William Barron, Aberdeen (GB); Alistair Bertram Clark, Aberdeen (GB)

(73) Assignee: DOWNHOLE PRODUCTS LIMITED, Portlethen, Aberdeen (GB)

Reexamination Request:
No. 90/012,589, Sep. 14, 2012

Reexamination Certificate for:

| | |
|---|---|
| Patent No.: | **6,435,275** |
| Issued: | **Aug. 20, 2002** |
| Appl. No.: | **09/378,858** |
| Filed: | **Aug. 23, 1999** |

(51) Int. Cl.

| | |
|---|---|
| ***E21B 17/00*** | (2006.01) |
| ***E21B 17/22*** | (2006.01) |
| ***E21B 17/10*** | (2006.01) |

(52) U.S. Cl.
CPC ..... *E21B 17/1042* (2013.01); *E21B 17/1064* (2013.01); *E21B 17/22* (2013.01)

(58) Field of Classification Search
USPC ..... 166/241.1, 241.3, 241.4, 241.6; 175/325.1, 325.5
See application file for complete search history.

(56) References Cited

To view the complete listing of prior art documents cited during the proceeding for Reexamination Control Number 90/012,589, please refer to the USPTO's public Patent Application Information Retrieval (PAIR) system under the Display References tab.

*Primary Examiner* — Patricia Engle

(57) ABSTRACT

A casing centraliser and assembly comprising a tubular and a centraliser, the centraliser comprising a plastics material.

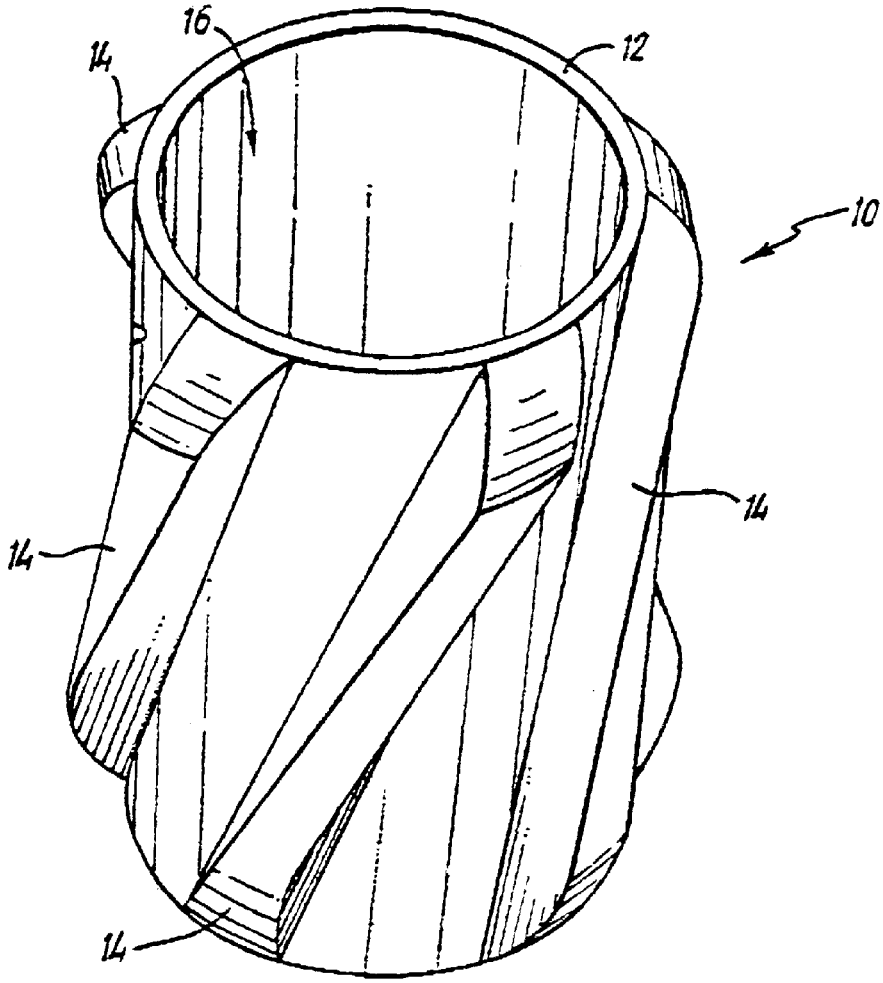

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-18 are cancelled.

* * * * *